US006161355A

United States Patent [19]

Gratt

[11] Patent Number: 6,161,355

[45] **Date of Patent: *Dec. 19, 2000**

[54] CONSTRUCTION USING ALUMINUM CANS

[76] Inventor: Lawrence B. Gratt, 2241 Kettner Blvd., Suite 220, San Diego, Calif. 92101

[ * ] Notice: This patent issued on a continued prosecution application filed under 37 CFR 1.53(d), and is subject to the twenty year patent term provisions of 35 U.S.C. 154(a)(2).

[21] Appl. No.: 09/039,509

[22] Filed: Mar. 16, 1998

[51] Int. Cl.[7] ..... E04C 2/08

[52] U.S. Cl. ..... 52/561; 52/DIG. 9; 52/565; 52/710; 52/577

[58] Field of Search ..... 52/DIG. 9, 306, 52/561, 565, 577, 710, 747.1; 53/48.3, 48.4

[56] References Cited

U.S. PATENT DOCUMENTS

| | | | |
|---|---|---|---|
| 1,413,169 | 4/1922 | Lawton | 52/306 |
| 1,465,653 | 8/1923 | Olander . | |
| 1,995,477 | 3/1935 | Kotrbaty | 52/710 |
| 2,351,615 | 6/1944 | James | 52/306 |
| 2,359,297 | 10/1944 | Brogden | 52/48.4 X |
| 2,476,433 | 7/1949 | Shinn | 52/577 X |
| 2,497,058 | 2/1950 | Reid | 52/577 |
| 3,054,482 | 9/1962 | Lassen | 52/561 X |
| 3,180,780 | 4/1965 | Ritter | 52/306 |
| 3,213,581 | 10/1965 | Macchi . | |
| 3,488,909 | 1/1970 | Bahr | 52/577 |
| 3,509,684 | 5/1970 | Hohl et al. | 52/48.3 X |
| 3,721,059 | 3/1973 | Reynolds . | |
| 3,802,367 | 4/1974 | Moore | 52/DIG. 9 |
| 3,837,131 | 9/1974 | Bisschops et al. | 52/577 |
| 3,857,215 | 12/1974 | Moore . | |
| 3,878,661 | 4/1975 | Moore . | |
| 3,885,296 | 5/1975 | Stout | 52/577 X |
| 3,932,973 | 1/1976 | Moore | 52/DIG. 9 |
| 3,982,362 | 9/1976 | Moore . | |
| 4,025,212 | 5/1977 | Block . | |
| 4,068,429 | 1/1978 | Moore . | |
| 4,084,363 | 4/1978 | Moore . | |
| 4,270,329 | 6/1981 | Moore . | |
| 4,354,334 | 10/1982 | Hara | 53/48.4 |
| 4,597,237 | 7/1986 | Celli . | |
| 5,287,677 | 2/1994 | Hunter | 53/48.3 X |
| 5,664,382 | 9/1997 | Melnick et al. | 52/561 X |
| 5,791,121 | 8/1998 | Bernier | 53/48.3 X |

*Primary Examiner*—Carl D. Friedman
*Assistant Examiner*—Phi Dieu Tran A
*Attorney, Agent, or Firm*—Henri J. A. Charmasson; John D. Buchaca

[57] ABSTRACT

A system of tracks, brackets and containers, typically empty beverage cans, assembled and used for temporary storage, temporary emergency shelters, toys, or other uses involving inexpensive and light weight building materials. The system is implemented by releasably attaching the containers to the tracks, then releasably attaching the tracks to each other either horizontally, vertically, or both to form structural elements such as beams, columns, or panels. The rigid tracks are made from a material which allows for apertures in the tracks to be sized to resiliently snap onto portions of the containers. The track may be formed in a variety of different shapes, such as straight, angled, curved, T-shaped or cross-shaped. Additionally, the brackets may be formed in a variety of different shapes to attach the track assemblies to each other in various orientations.

12 Claims, 5 Drawing Sheets

FIG. 9
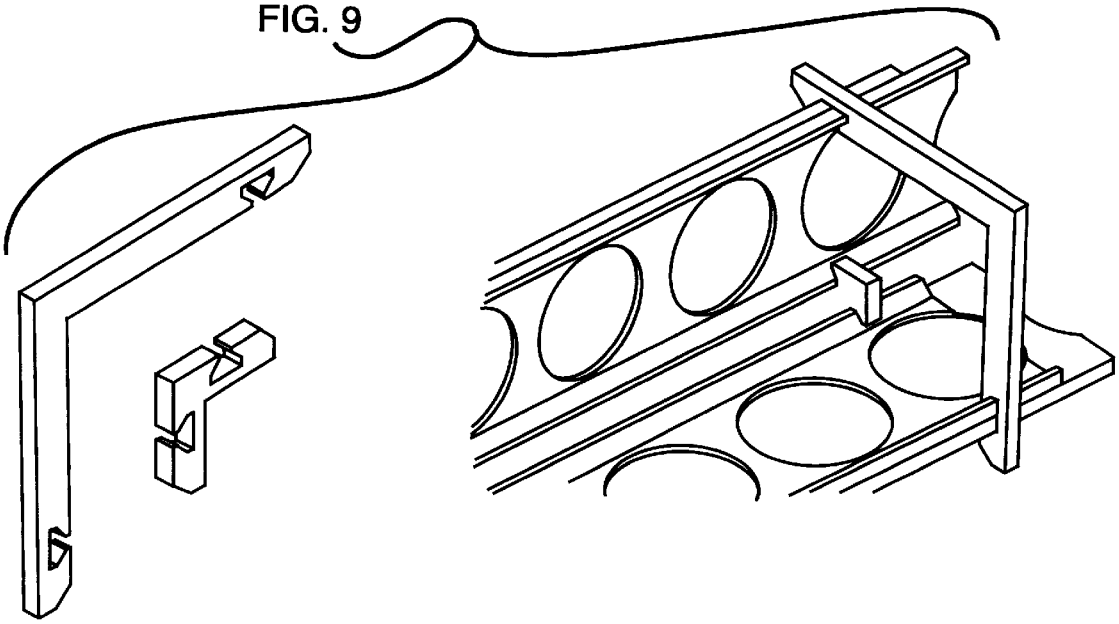
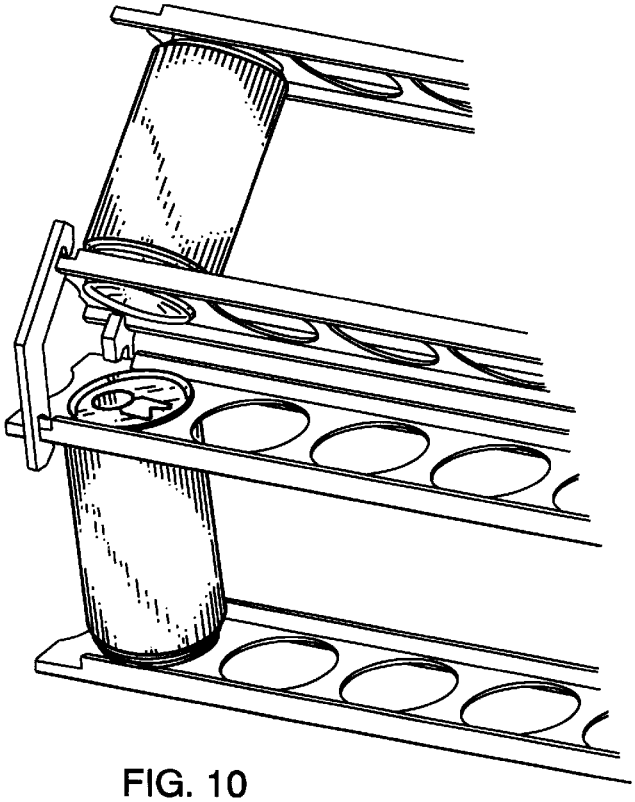
FIG. 10

CONSTRUCTION USING ALUMINUM CANS

FIELD OF THE INVENTION

This invention relates to the field of panel and structural support construction and more specifically for temporary structures.

BACKGROUND OF THE INVENTION

There are limited means available to simply and inexpensively construct structures which may be used for temporary storage, temporary emergency shelters, toys, or other uses involving inexpensive and light weight building materials. Currently, this may be accomplish using a tent, trailer, various prefabricated molded plastic elements, etc. While tents are typically light weight in relation to the area which is sheltered, they are often complex in their assembly and are rarely able deviate from a specific individual design, in that the size and shape are static. Trailers are heavy, require another vehicle for transport and again their size and shape are static. Prefabricated molded plastic building materials, as used in children's toys, may allow for some variation in size and shape, but still limit a user's creativity, usually require an adult for assembly and are expensive. Additionally, all of these examples use raw resources and seldom recycled goods.

SUMMARY OF THE INVENTION

Accordingly, there is a need for building materials that can be easily used by anyone, can be purchased by a larger customer base, allow for creative and dynamic design, and use recycled materials. This can be implemented by employing a system of tracks, brackets and used containers, typically empty beverage cans. The cans are attached to the tracks and the resulting assemblies are in turn stacked upon each other using securing brackets, forming panels which may be used as walls or ceilings. The structures may be designed to have doorways and windows and may be combined to form a housing with multiple rooms. The completed structure may be used as a storage shed, emergency shelter, a toy for children, etc.

BRIEF DESCRIPTION OF THE INVENTION

FIG. 9 is a perspective view of various angle brackets;

FIG. 10 is a partial perspective view of an angled track connection;

DESCRIPTION OF THE PREFERRED EMBODIMENT

Figure 1:
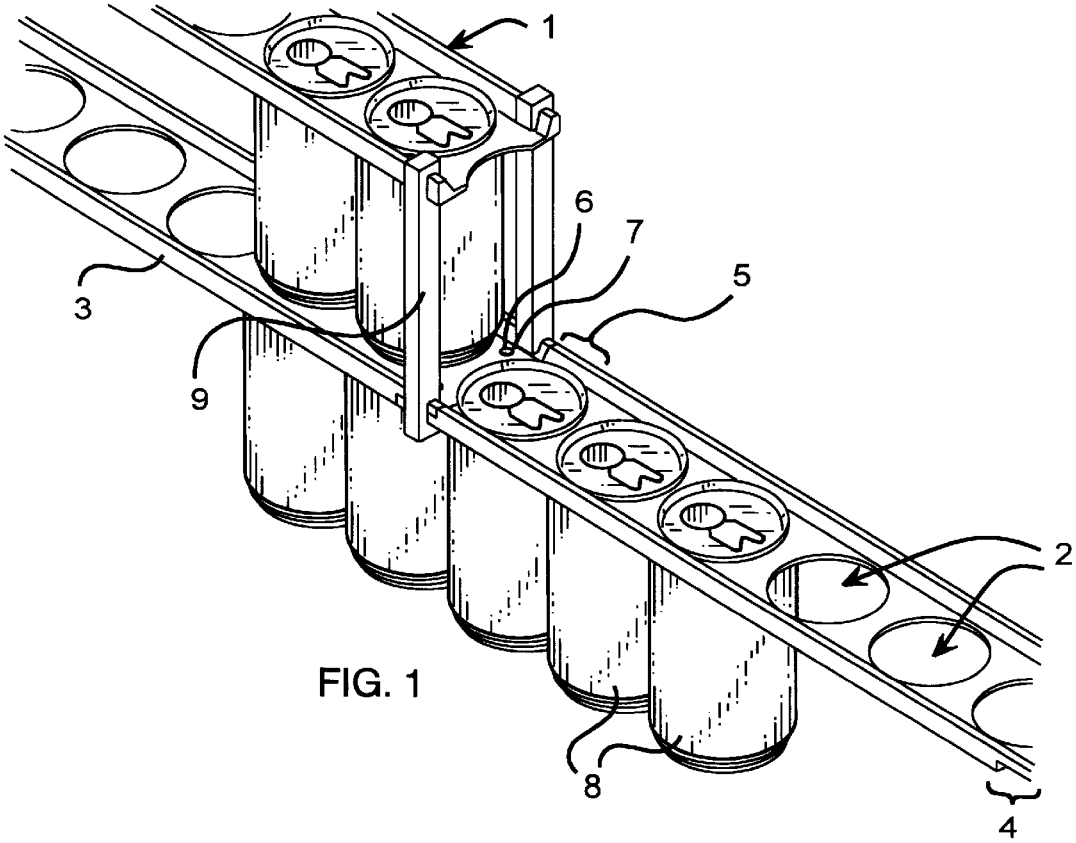
FIG. 1 is a perspective view of a partial track and can assembly according to the invention.

Referring now to the drawing, there is shown an assembly of a plurality of symmetrical cylindrical containers 8, preferably empty beverage cans, mounted on tracks 1. The tracks are in turn attached to each other, by means of brackets 9, to give shape to the final structure. The tracks 1 consist of a central web defining a plurality of apertures 2, side rails 3, proximate and distal ends 4 and 5, and interlocking means, preferably a "button and hole" style 6 and 7 respectively.

Apertures 2 are sized to resiliently accept cylindrical containers 8, but may be devoid of cylindrical units when an opening in the wall is preferred. While the preferred embodiment uses symmetrical cylindrical containers, an alternate embodiment could use various sized containers for aesthetic value or structural integrity. The rails are resiliently accepted by notches 10 in brackets 9, preferably in a dove-tail fashion, so the brackets may be easily snapped into place.

Figure 2:
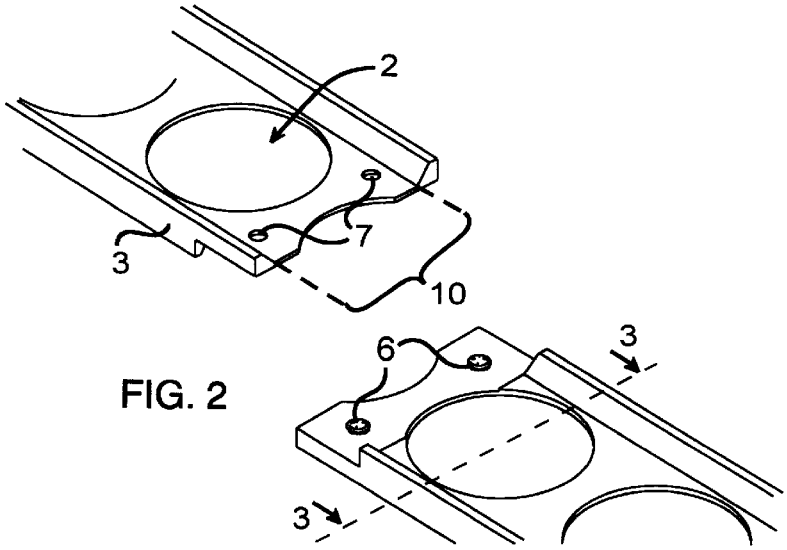
FIG. 2 is an exploded perspective view of the track connection.

A detailed view of the preferred means for connecting the tracks is shown in FIG. 2. The ends 4 and 5 shaped and dimensioned are so the tracks may be interlocked end to end. Preferably, they are formed to overlap without any appreciable change in height, but this may not be necessary when certain applications do not require such precision. A stable connection is made when the buttons 6 on the distal end 5, resiliently "snap" into holes through the proximate end 7 of adjacent track. However, this connection may be achieved by a number of alternate means, such as ends of adjacent tracks being riveted together, a dove-tail interlock, etc.

Figure 3:
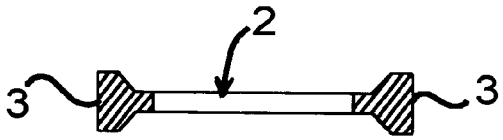
FIG. 3 is a cross-sectional view of a track taken along line 3—3 of FIG. 2.

FIG. 3 is a cross-sectional view of the track in FIG. 2 disclosing the preferred symmetric shape of the rails 3 and the aperture 2, such that the cylindrical units and brackets may be connected, even if the track is turned up-side down.

Figure 4:
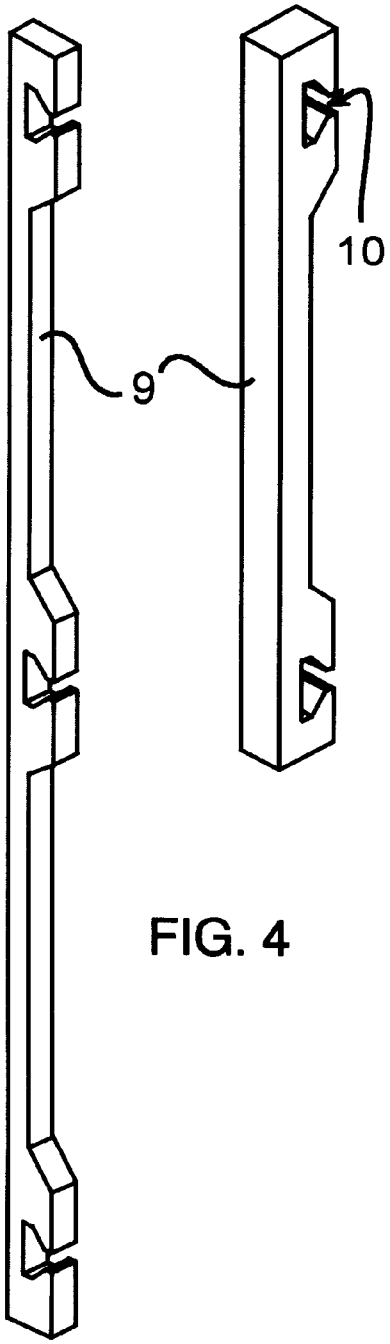
FIG. 4 is a perspective view of a vertical track-tying bracket.

FIG. 4 shows the detail of the bracket used for securing track and can assemblies vertically. Additionally, the vertical brackets may be formed to secure two or more track and can assemblies. Both depict the preferred symmetry in the rail receiving cleft, which allows use of bracket regardless of orientation.

Figure 5:
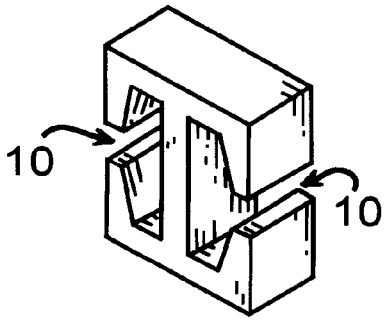
FIG. 5 is a perspective view of a horizontal track-tying bracket.

FIG. 5 shows a bracket which secures the assemblies horizontally. Again, note the preferred symmetry in the rail receiving cleft.

Figure 6:
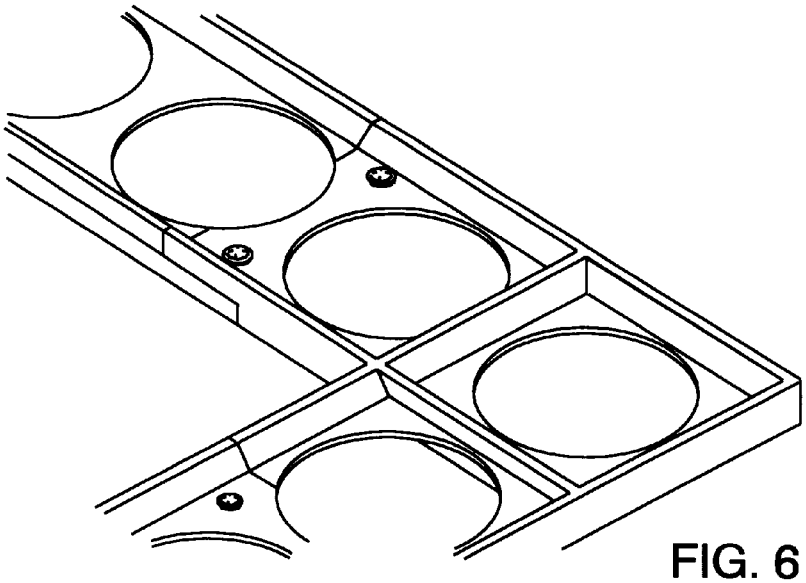
FIG. 6 is a perspective view of a right-angle track section.
Figure 7:
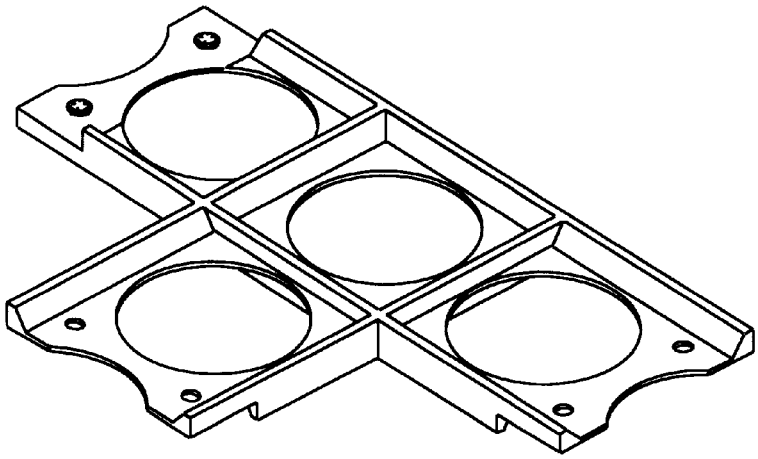
FIG. 7 is a perspective view of a T-shaped track section.
Figure 8:
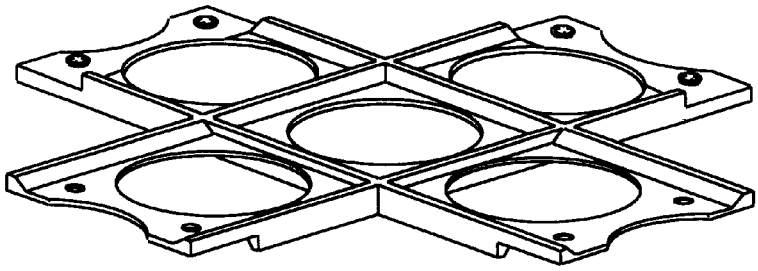
FIG. 8 is a perspective view of a cross-track section.

FIGS. 6, 7 and 8 show variations of the track in right angle, T-shaped, and cross-shaped formations respectively. FIGS. 9 and 10 show variations of the bracket which will orient the tracks at varying degrees to one another.

Figure 11:
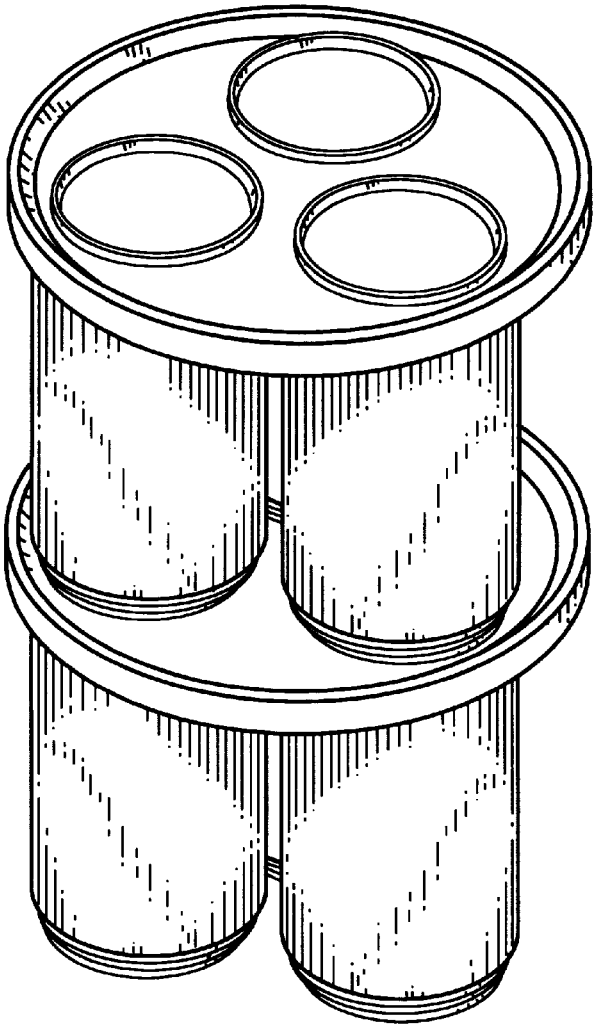
FIG. 11 is a perspective view of a partial columnar assembly.
Figure 12:
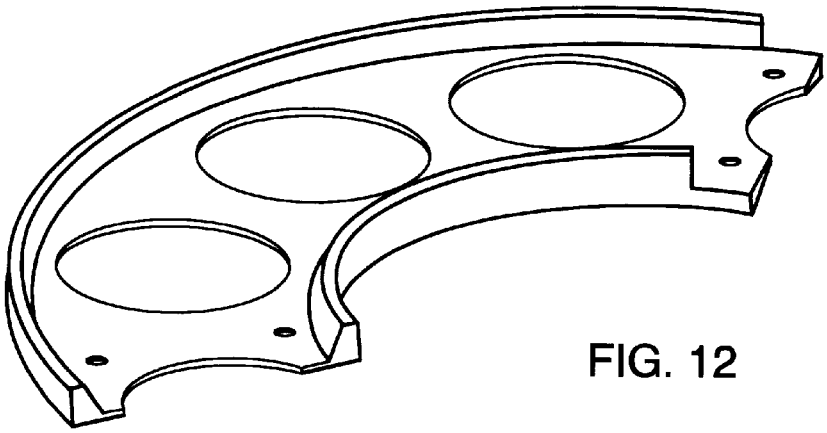
FIG. 12 is a perspective view of an arcuate track.

FIGS. 11 and 12 show circular and arcuate versions of the tracks respectively. While these depictions represent only the most standard track and bracket variations, any number of custom variations may be had and still adhere to the basic design and objectives of this invention.

The final structure may consist of a single wall, which may serve as a windbreak, or multiple walls and a roof, which may serve as a storage or emergency shelter, play area, or any imaginable variation therefrom. If additional rigidity, permanence, or insulation is required, a number of modifications may be made to the structure. For instance, a tarp, or similar material, may simply be placed around the structure, or a spray-on foam may be applied to fill in the space between the cans. When sealed, the lack of air movement within the cylinders will provide insulation to the structure.

The structure can also be used as filler as well as structural elements in poured concrete or injection molded walls.

What is claimed is:

1. A panel building assembly comprising in combination:

a plurality of containers;

a plurality of interlocking tracks, wherein each of said tracks comprises:

a central web having distal and proximate ends, a rail along each edge between the proximal and distal ends, wherein said web is shaped to define a row of substantially circular apertures between the ends wherein each of said apertures is sized and positioned for resiliently snapping axially over and capturing one of said containers; and means for interlocking said tracks.

2. The assembly of claim 1, wherein said containers are symmetrical.

3. The assembly of claim 1, wherein said containers comprise empty beverage cans.

4. The assembly of claim 1, wherein said means for interlocking comprise:

said distal end being formed to overlap said proximal end of an adjacent track.

5. The assembly of claim 4, wherein said means for interlocking comprise fasteners on said proximal end resiliently passing through holes in said distal end.

6. The assembly of claim 1, wherein said means for interlocking comprise buttons formed in said distal end which resiliently pass through holes in said proximate end of an adjacent track.

7. The assembly of claim 1 which further comprises T-shaped three-way interlocking tracks.

8. The assembly of claim 1 which further comprises cross-shaped, four-way interlocking tracks.

9. The assembly of claim 1 which further comprises right angle interlocking tracks.

10. The assembly of claim 1 wherein said tracks are arcuate.

11. The assembly of claim 1 which further comprises a plurality of superimposed tracks; and means for interlocking said superimposed tracks.

12. A panel building assembly comprising in combination:

a container having an end portion;

a track comprising:

a central web of resilient material terminating at distal and proximate ends;

a pair of side rails;

said web being shaped to define a row of substantially circular apertures through said web; and wherein each of said apertures is sized to resiliently snap axially over and capture said end portion of said container and thereby mount said container to said track.

* * * * *